United States Patent [19]

Pardes et al.

[11] 4,161,070

[45] Jul. 17, 1979

[54] LASER RANGEFINDER TRAINER

[75] Inventors: Herman I. Pardes, Wanamassa; Frederick B. Sherburne, Oceanport, both of N.J.

[73] Assignee: The United States of America as represented by the Secretary of the Army, Washington, D.C.

[21] Appl. No.: 917,223

[22] Filed: Jun. 20, 1978

[51] Int. Cl.[2] ..... F41G 3/26

[52] U.S. Cl. ..... 35/25; 273/101.1

[58] Field of Search ..... 35/25; 350/1.5, 1.6, 350/154, 155, 288, 290, 291; 273/101.1

[56] References Cited

U.S. PATENT DOCUMENTS

| | | | |
|---|---|---|---|
| 2,776,598 | 1/1957 | Dreyer | 350/155 |
| 3,288,625 | 11/1966 | Kauer | 350/1.5 X |
| 3,813,795 | 6/1974 | Marshall et al. | 35/25 |
| 3,888,022 | 6/1975 | Pardes et al. | 35/25 |
| 3,964,178 | 6/1976 | Marshall et al. | 35/25 |
| 3,996,674 | 12/1976 | Pardes et al. | 35/25 |

*Primary Examiner*—William H. Grieb

*Attorney, Agent, or Firm*—Nathan Edelberg; Sheldon Kanars; Daniel D. Sharp

[57] ABSTRACT

A system for facilitating the training of a trainee to operate a target rangefinder. The system includes a slide (or film) projector for projecting a battlefield scene including one or more targets onto a viewing screen. The slide includes data annotated thereon corresponding to the range of the target; the target range is communicated to an operating console. A rangefinder simulator includes a means for generating a laser beam. In operation, the trainee sights the target, sets the range gate and fires the laser beam. When the laser beam hits the target, the console displays the proper range data which is then compared to the range set on the simulator by the trainee.

6 Claims, 6 Drawing Figures

LASER RANGEFINDER TRAINER

The invention described herein may be manufactured and used by or for the United States Government for governmental purposes without the payment of any royalties thereon or therefor.

BACKGROUND OF THE INVENTION AND PRIOR ART STATEMENT

U.S. Pat. No. 3,888,022 entitled "Moving Target Screen" issued to H. I. Pardes, J. R. Schwartz and F. B. Sherburne and assigned to the same assignee as the present invention discloses a system wherein motion picture scenes are projected on a viewing screen to provide trainees with simulated realistic scenes for tactical and marksmanship training.

U.S. Pat. No. 3,888,022 discloses a system wherein each frame of the projected film contains a first portion representing a scene including at least one target area. Each frame of the film also includes a second portion which is substantially opaque to laser radiation except for a transparent region thereof corresponding in location exactly to the location of the selected target area in the first portion of the film frame. The two portions of the film frames are superimposed to present only the target scene to the viewer.

Each weapon operated by the trainee has a low power laser unit attached thereto which can be excited by actuating the weapon trigger, and by automatic electronic controls, thereby firing a laser beam at the target. If the laser beam is properly aimed at the selected target area of the scene on the projection screen, the beam will be directed to reflect onto hit detection means while an improperly aimed laser beam will not reflect onto the hit detection means.

U.S. patent application Ser. No. 885,149 entitled Moving Target Screen with Improved Optical Control, filed on Mar. 10, 1978 in the names of F. B. Sherburne, H. I. Pardes and E. Hughes, and assigned to the same assignee as the present invention discloses and claims an improvement to the projection and reflective lens system of U.S. Pat. No. 3,888,022. More specifically, the lens system of U.S. patent application Ser. No. 885,149 includes a dichroic mirror which permits the entire projecting lens to be utilized to project the scene, i.e. light in the visual spectrum to pass directly through the mirror, but which reflects the high frequency laser beam to thereby provide an increase in relative illumination of the projected scene.

SUMMARY OF THE INVENTION

The present invention discloses a system for providing a simulated battlefield scene for enabling a trainee to train or practice in the use of a rangefinder. The system includes a rangefinder simulator having means for generating and firing a low power laser beam. A slide projector is provided which projects a battlefield scene on a screen. Each scene includes one or more targets located in the scene, and each slide includes range data coded thereon which is communicated to a control console. In operation, the trainee aims at, and ranges onto, the target and adjusts the rangefinder to indicate the range of the target and next fires the laser beam. When the laser beam hits the target the console displays the correct range of that target, which correct range is then compared to the range set on the simulator by the trainee.

The inventive system may also be utilized to range on multiple targets on the same battlefield screen by segmenting the scene into areas and providing coded range data for the target positioned in that segment of the scene.

DESCRIPTION OF THE PREFERRED EMBODIMENT OF THE INVENTION

Figure 1:
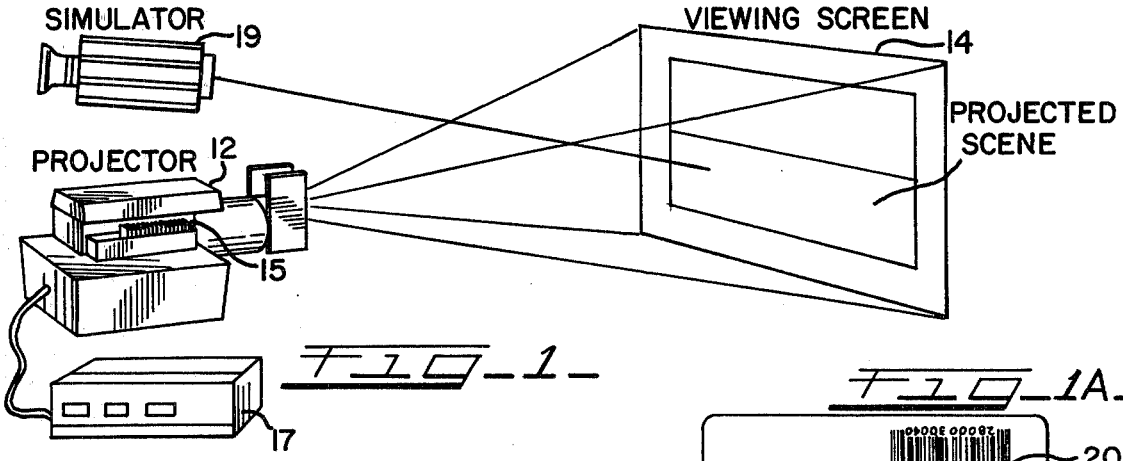
FIG. 1 shows the components of the inventive system including a rangefinder simulator, a slide projector, a viewing screen and a control console.

FIG. 1 shows the inventive system for training an operator trainee to operate a rangefinder. In FIG. 1 a slide projector 12 projects a battlefield scene from a selected slide 15 onto a viewing screen 14. The projector 12 includes a data receiver and a data recorder, not shown, of a suitable type known in the art. Projector 12 also includes special optics or lens assembly, as will be explained hereinbelow with reference to FIG. 3. The projector 12 is connected to a control and display console 17. A rangefinder simulator 19 to be used by the trainee includes conventional optics to range onto a target, and which may be adjusted to display the distance to the target. Further, the simulator 19 includes an eye safe Gallium-Aluminum-Arsenide low power laser device, as is known in the art.

Figure 1A:
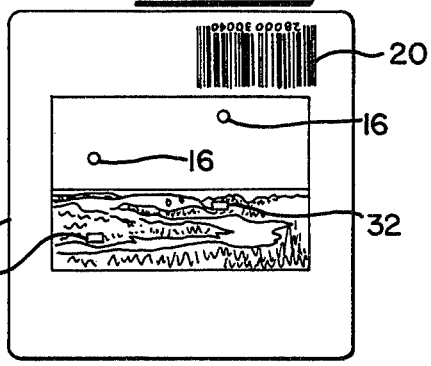
FIG. 1A shows a typical slide which is projected on the screen and which includes coded range data.

Referring to FIG. 1A, each slide 15 includes annotated coded data thereon as indicated by reference numeral 20. Each slide 15 comprises a scene portion, and a mask portion having scoring apertures 16 formed thereon, for purposes to be explained hereinbelow with specific reference to FIG. 4.

Figure 2:
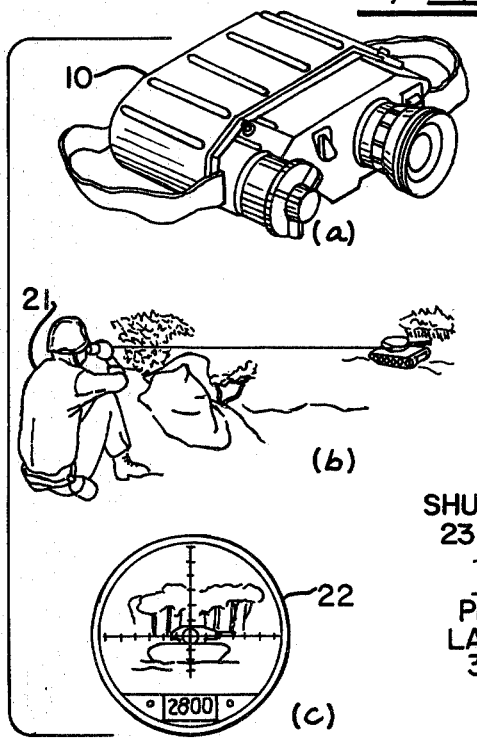
FIG. 2 is a pictorial illustration of a battlefield scene which the inventive system simulates.

Refer now to FIG. 2 which pictorially illustrates a battlefield scene which the inventive system seeks to simulate or duplicate. FIG. 2*a* illustrates the rangefinder 10 which the trainee 21 in FIG. 2*b* is utilizing to aim at and range onto the target indicated as an armored tank. The eyepiece 22 of the range finder 10 provides a view such as shown in FIG. 2*c* to the trainee when the trainee has properly aimed and ranged on the target.

The present invention permits the rangefinder operation and battlefield scene of FIG. 2 to be conveniently simulated within a confined training area such as a classroom. Further, a number of different scenes and targets can be quickly presented and changed; hence, providing more efficient and expeditious training at lower cost.

Figure 3:
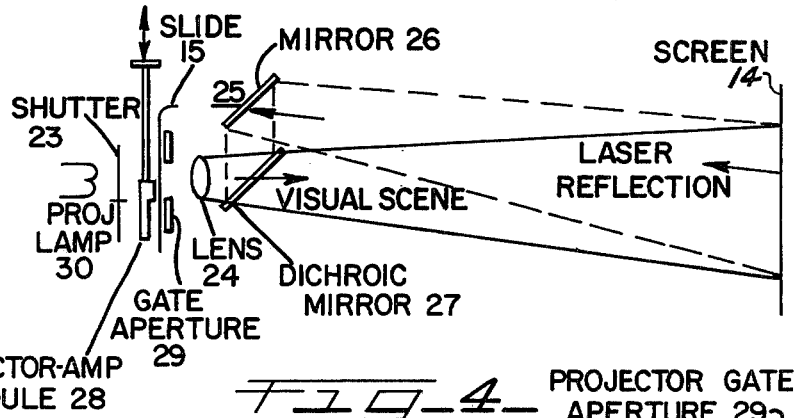
FIG. 3 depicts the optics or lens assembly utilized in the projector of the inventive system.

FIG. 3 depicts the optics or lens assembly of the inventive system. In FIG. 3 the picture or scene on a slide 15 is projected onto the viewing screen 14 by a conventional projection lamp 30, shutter 23, condensing lens 24 and by way of a stereo reflector 25 consisting of a first surface mirror 26 and a dichroic mirror 27. Mirror 26 is tiltable and adjustable relative to the stationary dichroic mirror 27. As is known, dichroic mirror 27 is designed to pass light having frequencies within a certain range and to reflect light having frequencies above the selected range. More specifically, the dichroic mirror 27 is designed to pass light of a wavelength up to approximately 0.75 micrometers; and, to reflect light in the infrared range, i.e., light of a wavelength above approximately 0.75 micrometers. Mirror 27 is positioned at approximately a 45° angle with the plane of the lens 24. The light from the projection lamp 22 passes through the lens 24 and the dichroic mirror 27 to illuminate the target scene on screen 14 as indicated by the solid lines of FIG. 3.

Figure 4:
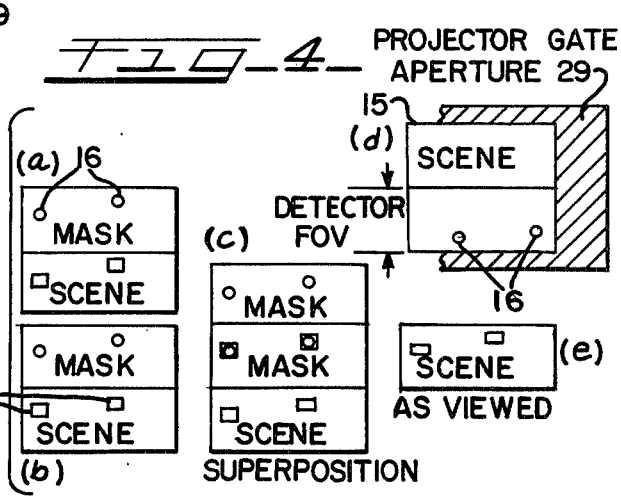
FIG. 4 shows the slide superpositioning utilized by the inventive system.

Referring now also to FIG. 4, FIG. 4 illustrates the superpositioning of slides as discussed in detail in U.S. Pat. No. 3,888,022, cited above. One half of each slide 15 contains an inverted normal positive scene while the other half of each slide containes a mask consisting of an opaque background in which there are formed one or more transparent apertures 16. The apertures 16 are located at the same relative position on the mask portion of each slide 15 as the corresponding target or targets 32 on the scene portion of each slide. Thus each projected slide or image includes a scene portion and a mask portion within which respective bright spots correspond to the apertures 16 appear. Note from FIGS. 3 and 4 that a slide 15 with scene and mask image is projected through the dichroic mirror 27 onto the screen 14. A second and identical scene and mask scene (b) is reflected from dichroic mirror 27 to mirror 26 and thence projected onto the screen 14. The moveable mirror 26 is adjusted until the apertures 16 or bright spots in the mask portion are superimposed on the targets in the scene portion of the projected image (see FIG. 4*c*).

After the proper initial adjustment of the mirror 26 has been made, the detector module 28 is moved into position to have a field of view as in FIG. 4*d* and the gate aperture 29 is arranged to block out the lower scene portion view of FIG. 4*c* as shown in FIG. 4*d* to provide a view as shown in FIG. 4*e*. Accordingly, only the scene portion of the projected image will be visible but the scoring aperture 16 will still be provided for sensing by the detector 28.

The operator or trainee thus sees the actual target scene on the screen and aims the simulator 19 at the target. When the rangefinder is accurately aimed and fired at the target, the laser beam is reflected from the screen, as indicated by the dotted lines in FIG. 3, to mirror 26 to further reflect to the dichroic mirror 27 and thence to pass through lens 24 to impinge on detector 28.

Thus the inventive system simulates actual field conditions by means of projection slides which include coded range data thereon and utilizes a laser beam device to simulate the operation of a rangefinder. The system provides a wide angle projection of an actual scene with a target at any desired range. A picture slide 15, taken under true field conditions, and annotated with rangefinder data obtained when the picture is taken is projected on the screen 14 which is normally positioned 10–15 meters distance.

In operation, the trainee searches for the target on the screen 14, both with the unaided eye and then using the rangefinder optics. The trainee then fires the rangefinder simulator at the target. Upon hitting the target, the information annotated on the slide is read out into the console and activates a suitable display. The trainee is then required to make the correct adjustments to obtain the true range return.

Multiple targets can be presented by segmenting the pickup detector 28 in the projector 12 such that each target is associated with a particular segment or area of the scene. The scene can be divided into a suitable number of segments, say 1 to 6 segments, without excessive additional cost.

Figure 5:
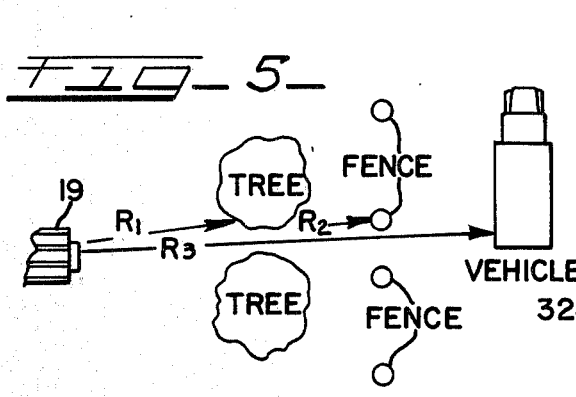
FIG. 5 shows a field situation wherein multiple targets are presented, and is useful in explaining one operation of the inventive system.

Refer now to FIG. 5 which is useful in explaining the operation of the system for ranging on multiple targets. In operation for multiple target ranging, a slide is inserted in the projector to project a scene having multiple targets on the screen, and the slide includes the range data coding for each target. The trainee activates the range gate of the simulator at maximum aperture and then aims at the target and fires the rangefinder. Assume the condition of FIG. 5 with a slide coded for multiple targets. When the trainee hits the target, the simulator readout will show one range, say R1, and will also activate the multiple target indicator.

The trainee must now set the minimum range dial on the simulator to a new value that is 20 meters greater then the range that he just measured and again range to the target area. Should the trainee get a new correct range R2 and another indication of multiple targets, the procedure is repeated for range R3 and until the reading is 000. This latter reading will indicate that all of the targets are located at ranges shorter than the one that has now been set as the rangefinder minimum and that all the targets in the laser beam path have been evaluated.

A moving picture scene may also be presented such that the trainee can range onto targets in motion. In this latter operation, annotation data is obtained at regular intervals assuming that the range does not change radically from the normal speed of ground targets.

The present invention thus comprises a system which enables a wide variety of terrain/topographic situations to be presented in rapid sequence in an indoor range in an inexpensive and readily available manner. Real time multiple returns can be simulated and presented to the trainee. Further, multiple stations can be accommodated if desired, and the system is eye-safe and should be comparatively inexpensive.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electro-optical rangefinder training system comprising a means for simulating a rangefinder operation including means for ranging onto a target and setting a range indication, a picture projector and viewing screen, each picture including a scene portion and a target designating portion and having data encoded thereon to indicate the range of targets on the picture, laser means associated with said ranging means to trigger a laser beam upon actuating said rangefinder, said projector including optic means for projecting a picture onto said screen, said screen reflecting the visual light and laser beam impinging thereon; and said projector optic means providing from each picture a scene portion and target visible to the eye and a target aperture, corresponding to the target, superimposed thereon and invisible to the eye but susceptible to a laser beam impinging thereon; and laser beam detection means, said projector optic means directing the laser beam reflected from said target to said detection means when said laser beam has hit the target, and means for receiving encoded data from said picture corresponding to the range of the target which has been hit whereby the setting on the ranging means may be compared with the actual range to the target.

2. A system as in claim 1 wherein said pictures are on slides and the coded data is marked on said slides.

3. A system as in claim 1 wherein said projector optic means comprises a first surface mirror and a dichroic mirror, said dichroic mirror being positioned adjacent said first surface mirror in the path of the projected images, and at an angle with respect to the direction of projection, for allowing visible light to pass therethrough onto said screen while reflecting a portion of said visible light toward said first surface mirror to thereby provide a means for superimposing the target apertures on said screen, and said mirrors directing the laser beam reflected by the target which is hit onto said detection means.

4. A system as in claim 1 wherein multiple targets at various ranges may be presented in said pictures, each of the pictures which have multiple targets thereon having coded range data pertaining to each particular target.

5. A system as in claim 4 wherein said slides may be segmented corresponding to multiple targets to provide coded data therefor.

6. A system as in claim 1 wherein the system projects pictures from moving film onto said screen and includes means for obtaining data at periodic intervals.

* * * * *